US005353563A

United States Patent [19]

White

[11] Patent Number: 5,353,563

[45] Date of Patent: Oct. 11, 1994

[54] PLASTIC STRUCTURALLY REINFORCED PANEL

[76] Inventor: Jack White, 305 Grove Ave., Cleveland, Tenn. 37311

[21] Appl. No.: 895,125

[22] Filed: Jun. 8, 1992

[51] Int. Cl.[5] ..... E04C 2/24

[52] U.S. Cl. ..... 52/309.13; 52/309.16; 52/827

[58] Field of Search ..... 52/270, 309.13, 309.16, 52/582, 827; 248/496, 498, 224.4, 225.2

[56] References Cited

U.S. PATENT DOCUMENTS

| | | | |
|---|---|---|---|
| 2,530,892 | 11/1950 | Mayo | 248/498 |
| 3,590,540 | 7/1971 | Johnson | 52/309.13 |
| 3,704,561 | 12/1972 | Meyer | 52/309.16 X |
| 3,928,691 | 12/1975 | Knudson | 52/309.16 X |
| 4,163,349 | 8/1979 | Smith | 52/309.16 X |
| 4,242,406 | 12/1980 | El Bouhnini et al. | 52/309.13 X |
| 4,284,447 | 8/1981 | Dickens et al. | 52/309.16 X |
| 4,331,723 | 5/1982 | Hamm | 52/309.16 X |
| 4,351,870 | 9/1982 | English, Jr. | 52/309.16 X |
| 4,471,591 | 9/1984 | Jamison | 52/309.16 X |
| 4,748,781 | 6/1988 | Wencley | 52/827 X |
| 4,817,360 | 4/1989 | Gorman | 52/309.13 X |
| 4,874,266 | 10/1989 | Thompson et al. | 248/225.2 X |
| 4,981,003 | 1/1991 | McCarthy | 52/309.16 X |
| 5,094,053 | 3/1992 | Militzer | 52/582 X |

*Primary Examiner*—Peter M. Cuomo
*Assistant Examiner*—Suzanne L. Dino
*Attorney, Agent, or Firm*—Veal & Associates

[57] ABSTRACT

A reinforced panel including a fiberglass reinforced plastic sheet and a framework having a plurality of interconnected beam members partially immersed within the plastic sheet. A plurality of woven straps soaked in plastic are pressed in perpendicular abutment with selected beam members with the ends of such straps being immersed within the plastic sheet. The plastic material, when completely solidified, bonds with the frame and the straps, thereby securing the frame to the sheet as a common structural unit. An alternative embodiment excludes the use of the straps and employs a cover bonded to the plastic sheet and the frame by plastics similar to that forming the plastic sheet.

20 Claims, 6 Drawing Sheets

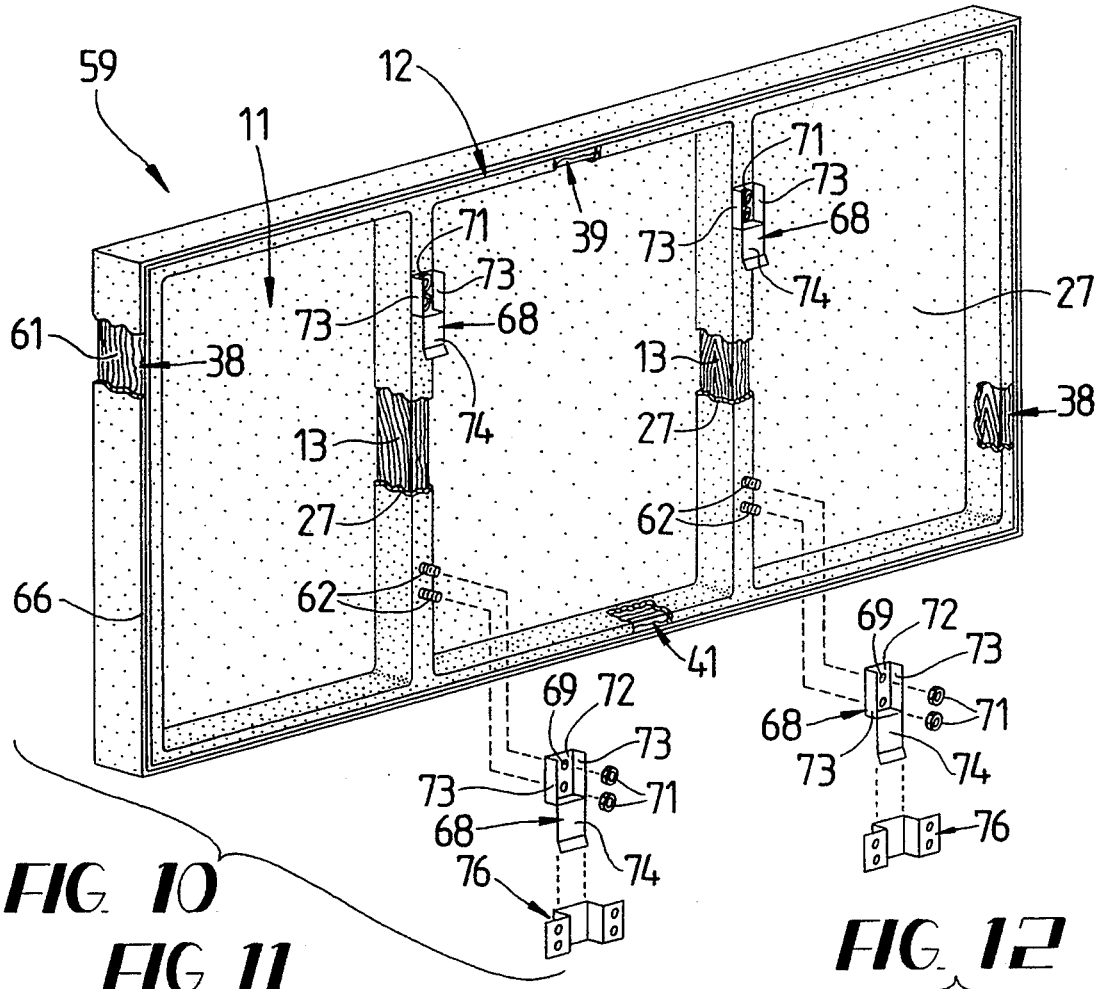
FIG. 10
FIG. 11
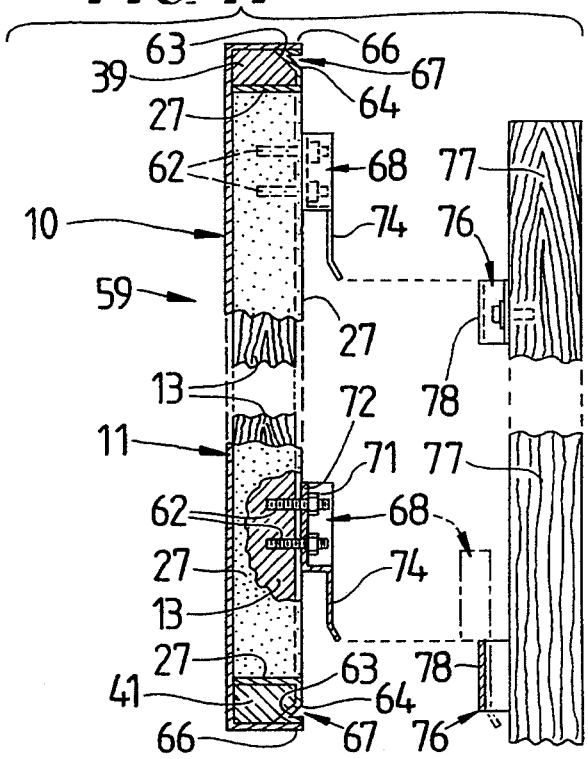
FIG. 12
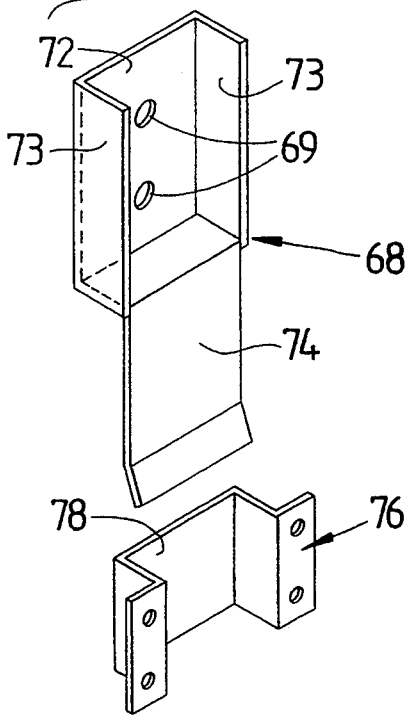

PLASTIC STRUCTURALLY REINFORCED PANEL

FIELD OF THE INVENTION

The present invention relates to prefabricated construction panels and more particularly to prefabricated panels constructed from flexible plastics reinforced with fiberglass. In greater particularity, the present invention relates to plastic panels reinforced by a rigid framework.

BACKGROUND OF THE INVENTION

Fiberglass reinforced plastic is a well-known construction material used to make anything from automobile bodies to siding for building construction. The plastic is typically applied over a fiberglass mesh or mixed with fiberglass fibers and sprayed over a mold. When the plastic is cured, it hardens around the fiberglass infrastructure into a substantially self-supporting rigid unit. However, the fiberglass reinforced plastic is not rigid enough or strong enough to support other heavy objects and, when molded in thin planar sheets, requires structural reinforcement to stand in a vertical plane.

When used in building construction, fiberglass reinforced plastic is typically molded in planar sheets or in corrugated form for extra rigidity. In either case, the sheets are typically secured to an existing building frame with bolts or flathead nails. This construction process is somewhat tedious since the entire outer frame must be built before the plastic panels are secured thereon. Substantial fitting and refitting of the panels to accommodate the inaccuracies of the frame structure requires the continued manipulation of the panels which are typically unwieldy because of their flexibility.

When bolts or nails are used to secure the sheets of plastic to the frame, the heads of the bolts and nails remain visible on the outer surface of the plastic thereby destroying the cosmetic continuity of the sheets. Nails, when driven through the plastic, tend to crack the plastic and bolts require the drilling of several holes therein. Fiberglass reinforced plastic is impermeable to the flow of air and is consequently used in some circumstances to create an airtight environment. If such is the case, the use of nails or bolts for connecting the sheets to a building's frame reduces the efficiency of the plastic as a protective insulator against the transfer of microscopic particles, therethrough.

SUMMARY OF THE INVENTION

It is the principal object of the present invention to provide a prefabricated reinforced plastic panel that can withstand excessive vertical stress while standing in a vertical plane.

In support of the principal object, another object of the invention is to provide a prefabricated reinforced plastic panel that has a smooth outer surface undisturbed by protrusions therefrom such as nails, bolts or other fastening members.

Yet another object of the invention is to provide a prefabricated reinforced plastic panel that incorporates all the aforementioned objects and presents an air impermeable outer face across the entire surface thereof.

Still another object of the present invention is to provide a prefabricated plastic panel that will resist twisting stresses exerted thereon.

These and other objects and advantages of my invention are accomplished through the use of a plastic sheet initially intermixed in liquid form with a fiberglass weave and allowed to harden. Before complete solidity is achieved, a framework having a plurality of interconnected beam members extending in a common plane is partially immersed within the plastic sheet. A plurality of woven straps soaked in a plastic similar to that forming the sheet are applied in perpendicular pressed engagement across selected beam members with the ends of such straps being immersed within the plastic sheet. The plastic material when completely solidified bonds with the frame and the straps securing the same therein.

The completed panels are assembled with other panels of similar construction to form a building structure. Such buildings have a horizontal foundation including a plurality of upwardly extending bolts. The panels have a horizontally extending lower beam member having a plurality of holes therein for receiving the upwardly extending bolts to secure the panels in perpendicular relation to the foundation.

The panels also include a pair of vertical side beams which define the lateral margin of the panel and have a plurality of apertures therein. Adjacent coplanar panels are connected by bolts which extend through corresponding apertures in the adjacent side beams. Adjacent panels meeting at angular relations are connected by angle members connected to the adjacent side beams by bolts extending through the angle members and selected apertures in the side beams.

An alternative method of forming a corner is to form a panel of selected angular dimension using methods previously described. The corner formed by the panel has a corner post extending vertically therealong, the post being connected to the plastic sheet using such previously described methods.

An alternate embodiment of the reinforced panel is used to form billboards having a relatively expansive display surface. The panel, which can be molded to any selected dimension, is particularly suited for billboard use since an uninterrupted display surface is presented having no bolts or seams to interfere with the cosmetic continuity of the advertisement displayed thereon. The billboard is constructed by immersing the framework of beam members into the plastic sheet using methods similar to that previously described. The margins of the plastic sheet are wrapped around the outer sides of the beam members forming the margin of the framework to extend normally to the planar surface of the plastic sheet. A plastic cover constructed similar to the plastic sheet is bonded to the plastic sheet and the framework immersed therein to form an integral construction unit. The marginal beam members are chamfered along an outer corner thereof most distal the planar surface of the sheet. The chamfers provide access to the edges of the plastic sheet to which the edges of the plastic cover are bonded. Hangers are bolted to the beam members and are detachably connected to brackets mounted to a selected surface from which the billboard is suspended.

BRIEF DESCRIPTION OF THE DRAWINGS

Apparatus embodying features of my invention are depicted in the accompanying drawings which form a portion of the disclosure and wherein:

FIG. 10 is a partially broken away perspective view of an alternate embodiment of the present invention;

FIG. 11 is an exploded sectional view of the embodiment shown in FIG. 10; and

FIG. 12 is an exploded perspective view of the hanger and bracket used in the embodiment shown in FIG. 10.

DESCRIPTION OF A PREFERRED EMBODIMENT

Figure 1:
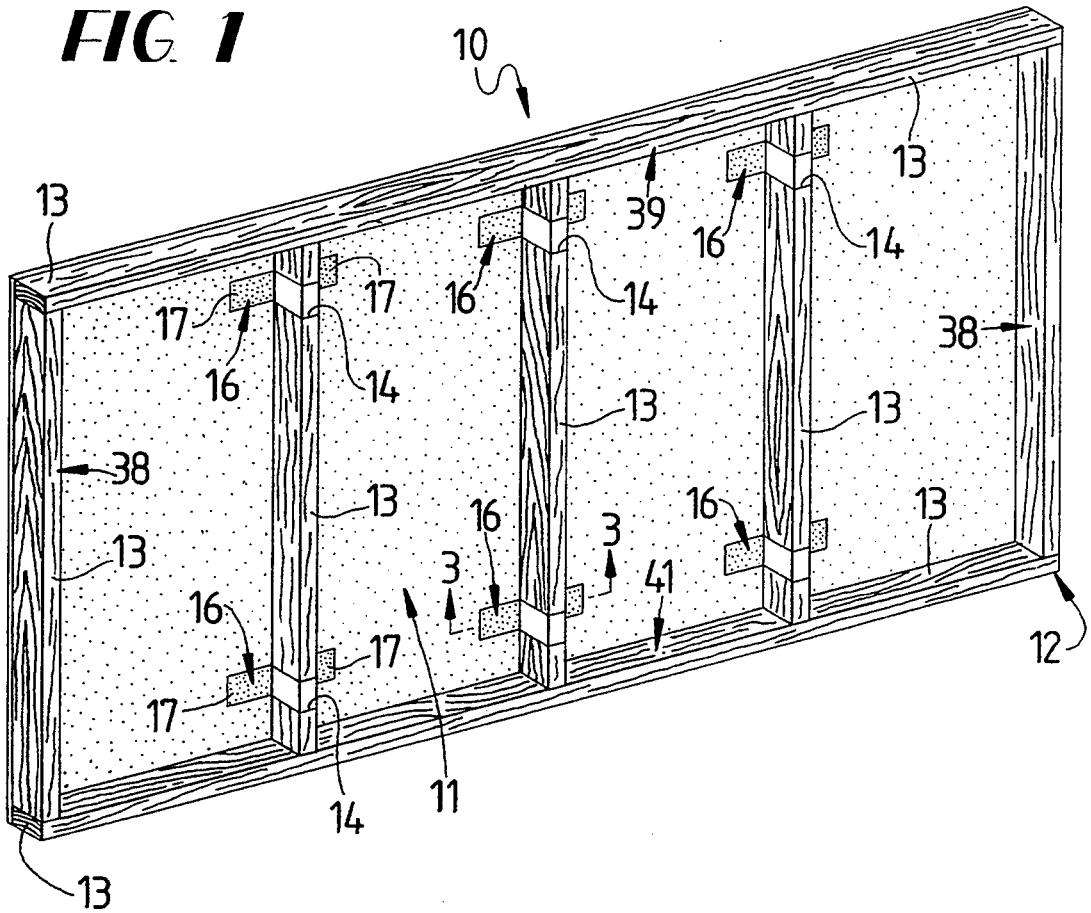
FIG. 1 is a perspective view of a first embodiment of the present invention.
Figure 2:
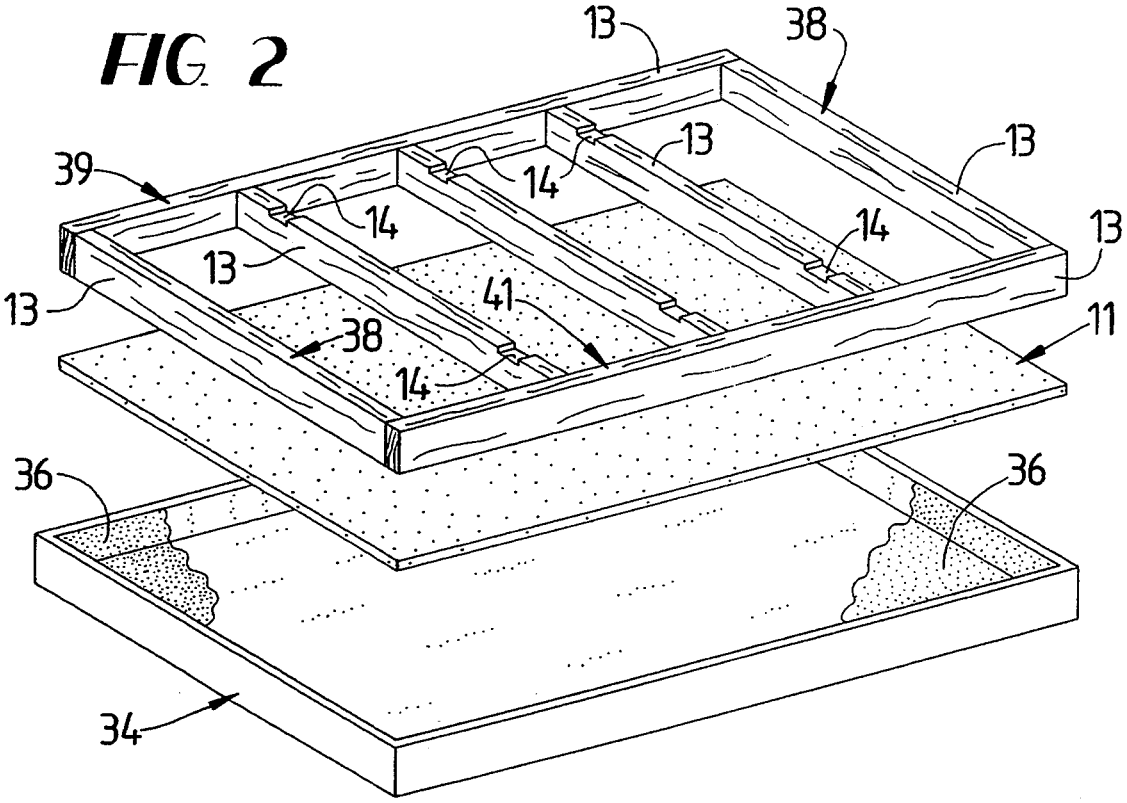
FIG. 2 is an exploded perspective view of a mold, a sheet of reinforced plastic and a frame.
Figure 3:
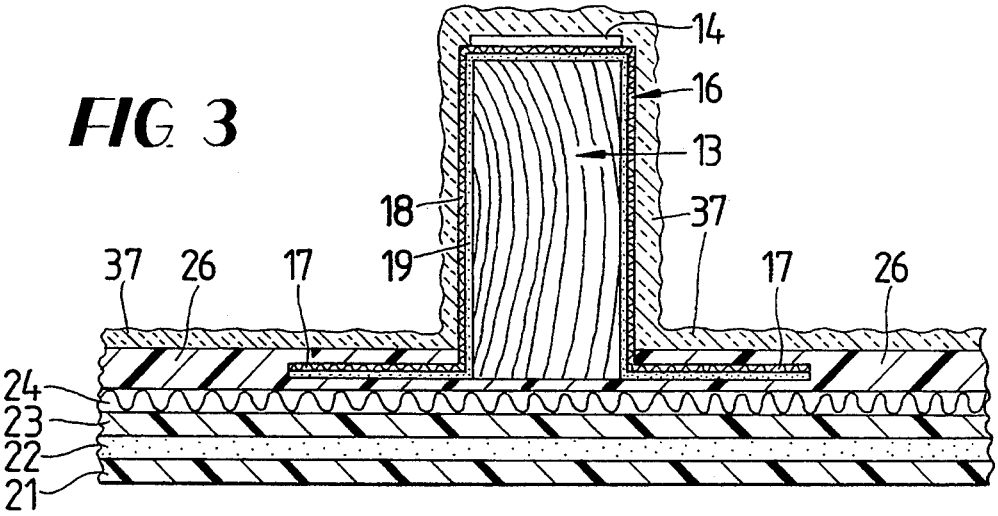
FIG. 3 is a sectional view taken along line 3—3 of FIG. 1 of the first embodiment of the present invention.

Referring to the drawings for a clearer understanding of the invention, it should be noted in FIGS. 1 & 2 that a first embodiment of the present invention is a panel 10 having a sheet 11 of reinforced plastic and a frame 12 partially immersed therein. The frame 11 includes a plurality of elongated beam members 13 interconnected within a common plane, each partially immersed a predetermined distance within the plastic sheet 11. Selected beam members 13 carry a plurality of laterally extending channels 14 thereon. A plurality of straps 16 having end portions 17 are received within the channels 14 and extend therefrom in normal relation to the plastic sheet 11. The end portions 17 of the straps are immersed within the plastic sheet 11 to secure the frame 12 thereto. As shown in FIG. 3, each strap 16 includes a strip of woven mesh 18 and a strip of matting 19 bonded in layered relation by a plastic similar to that forming the plastic sheet 11. As shown in FIG. 3 the plastic sheet 11 includes a first layer 21 of polyester resin and catalyst, a first mat 22 bonded to the first layer 21, a second layer 23 of polyester resin and catalyst bonded to the first mat 22, a first fiberglass weave 24 bonded to the second layer 23, and a third layer 26 of polyester resin and catalyst bonded to the first fiberglass weave. The layers of polyester resin and catalyst 21, 23, and 26 permeate the first mat 22 and first fiberglass weave 24 and form an integral constructive unit therewith. The beam members 13 and the end portions 17 of the straps 16 are immersed within the third layer 26 of polyester resin and catalyst and are bonded thereto.

Figure 4:
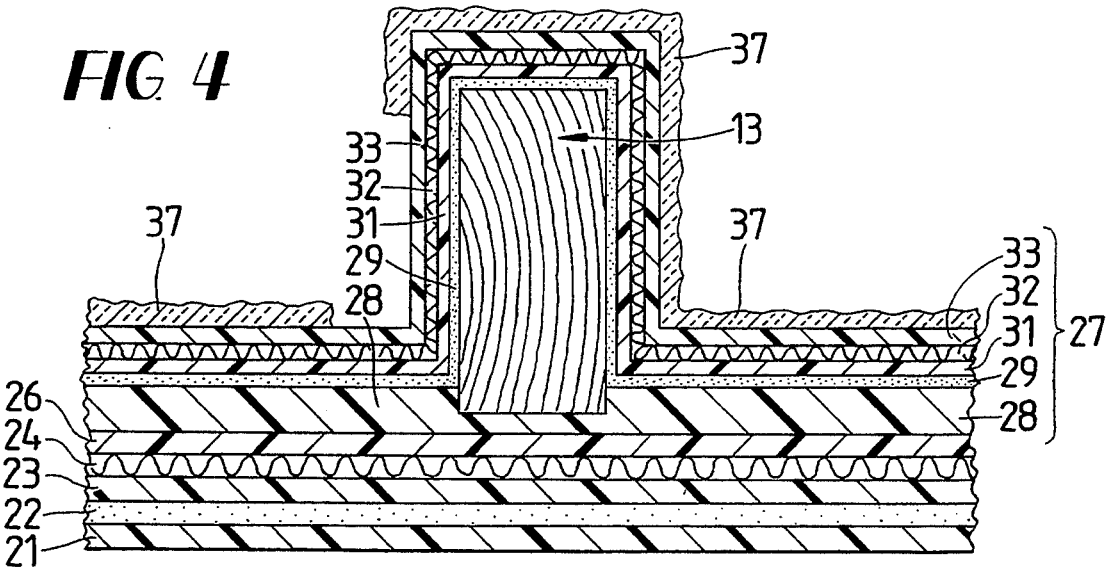
FIG. 4 is a sectional view of a second embodiment of the present invention.

As shown in FIG. 4, a second embodiment of the present invention includes the aforementioned elements disclosed in the first embodiment exclusive of the channels 13 and the straps 16. In addition, the second embodiment includes a cover 27 having a fourth layer 28 of polyester resin and catalyst laminated over the third layer 26 and the beam members 13 in bonded contact therewith, a second mat 29 laminated on the fourth layer 28, a fifth layer 31 of polyester resin and catalyst laminated on the second mat 29, a second fiberglass weave 32 laminated on the fifth layer 31 and a sixth layer 33 of polyester resin and catalyst laminated on the second fiberglass weave 32. The layers of polyester resin and catalyst 28, 31 and 33 permeate the second mat 29 and the second fiberglass weave 32 and are bonded thereto in integral relation therewith.

As shown in FIGS. 1 & 2, the plastic sheet 11 and the frame 12 are rectangular with the frame 12 including a pair of vertical side beams 38 defining the lateral margins of the panel 10, an upper beam member 39 connected to an uppermost extremity of each vertical side beam 38 in perpendicular relation thereto and a lower beam member 41 connected to a lowermost extremity of each side beam 39.

Figure 6:
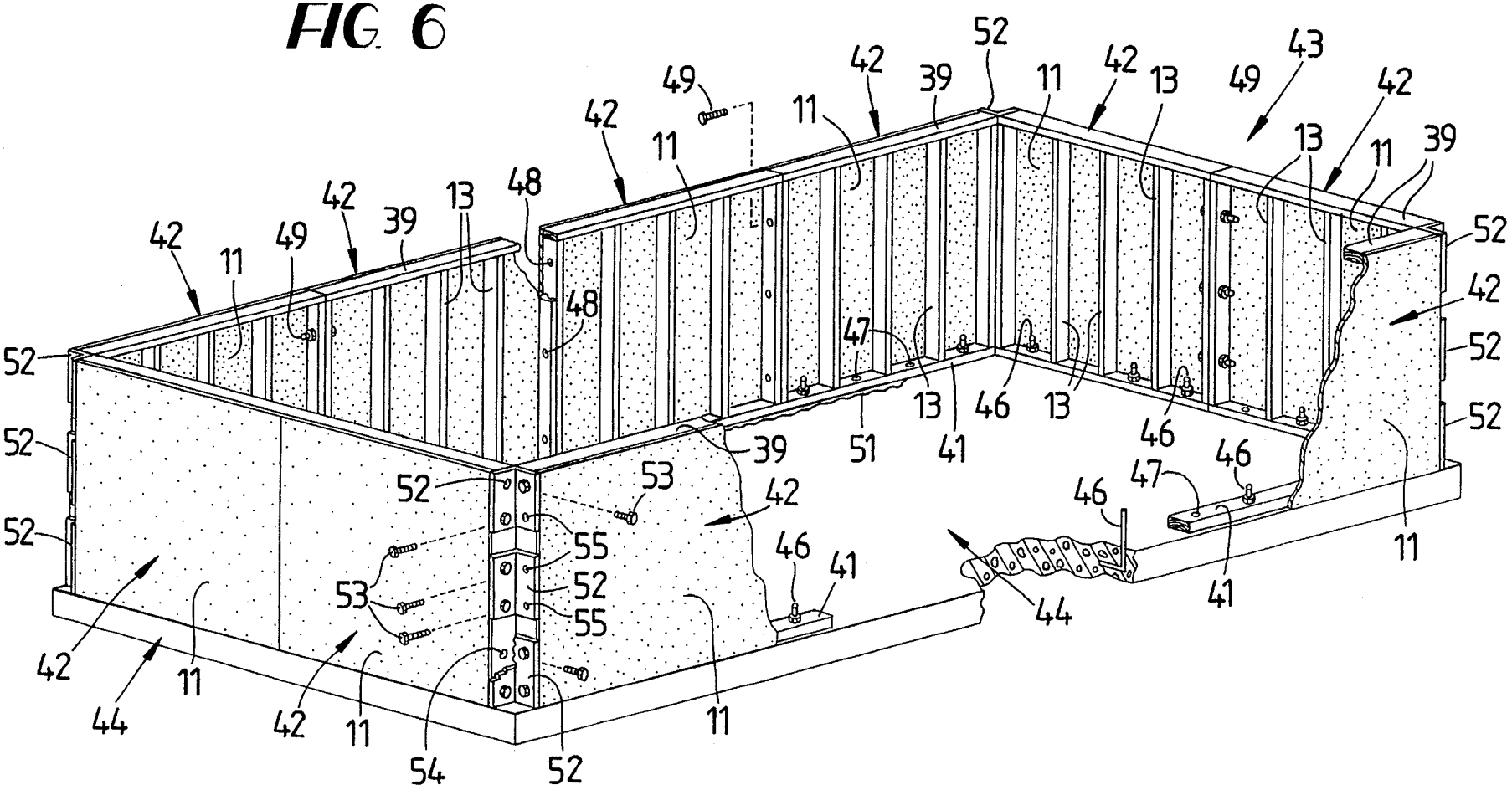
FIG. 6 is a perspective view of the present invention as used to form a building structure.

As shown in FIG. 6 the panel 10 is used with other such panels 42 of similar construction to form a building 43. The building 43 includes a substantially horizontal foundation 44 shown in FIG. 6 to be constructed of cement but not limited thereto. The foundation 44 has a plurality of bolts 46 connected thereto and extending upwardly therefrom. When the foundation 44 is constructed of cement, as shown in FIG. 6, the bolts 46 are immersed within the cement as the foundation is poured and secured therein by the setting of the cement to a hardened consistency. The lower beam member 41 has a plurality of holes 47 therein which receive selected ones of the plurality of bolts 46 to secure the panel 10 to the foundation 44 in perpendicular relation thereto.

Figure 8:
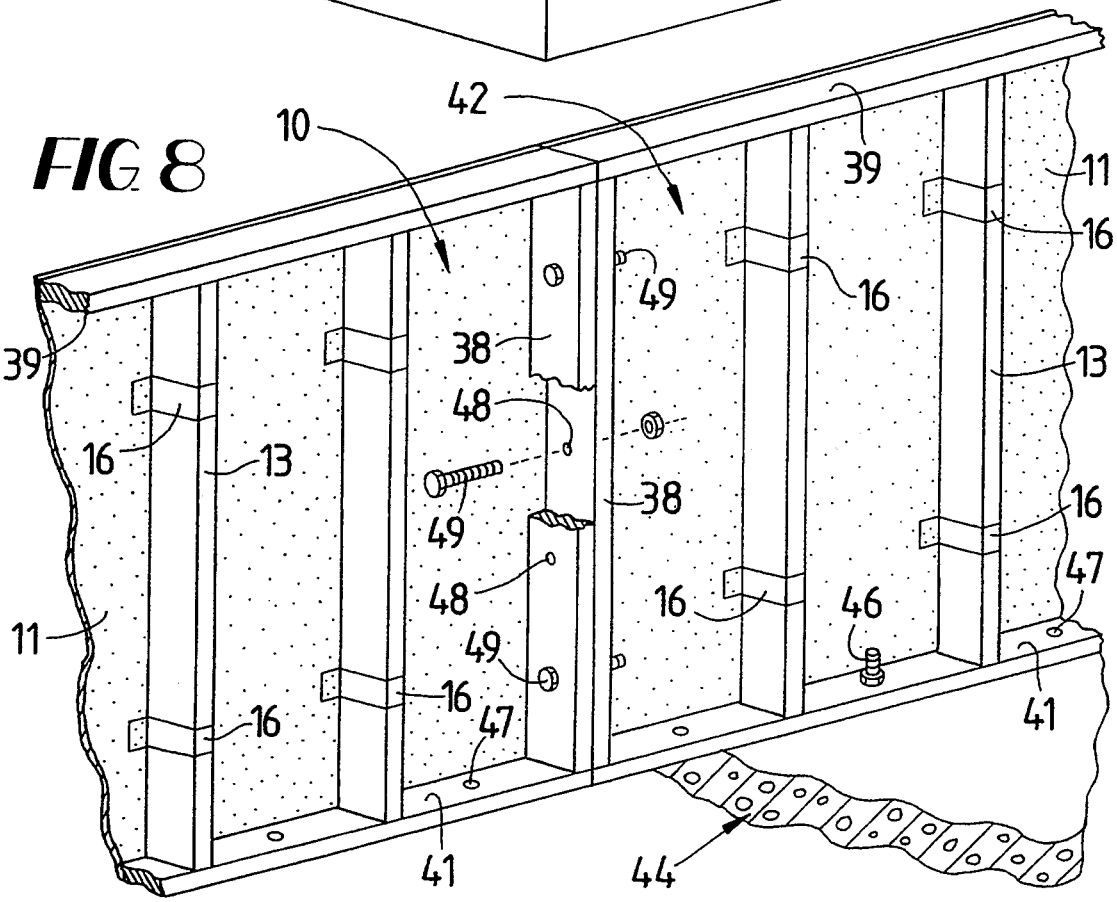
FIG. 8 is a perspective view of two panels connected in coplanar relation.

As shown in FIGS. 6 and 8, selected panels 10 and 42 are connected to the foundation 44 in adjacent coplanar alignment. The panels have corresponding apertures 48 extending through adjacent side beams 38 for receiving bolts 49 therein to connect said adjacent panels 10 and 42. Sealant 51 is applied intermediate the adjacent side beams 38 and intermediate the lower beam member and foundation to hermetically seal the connection thereof.

Figure 7:
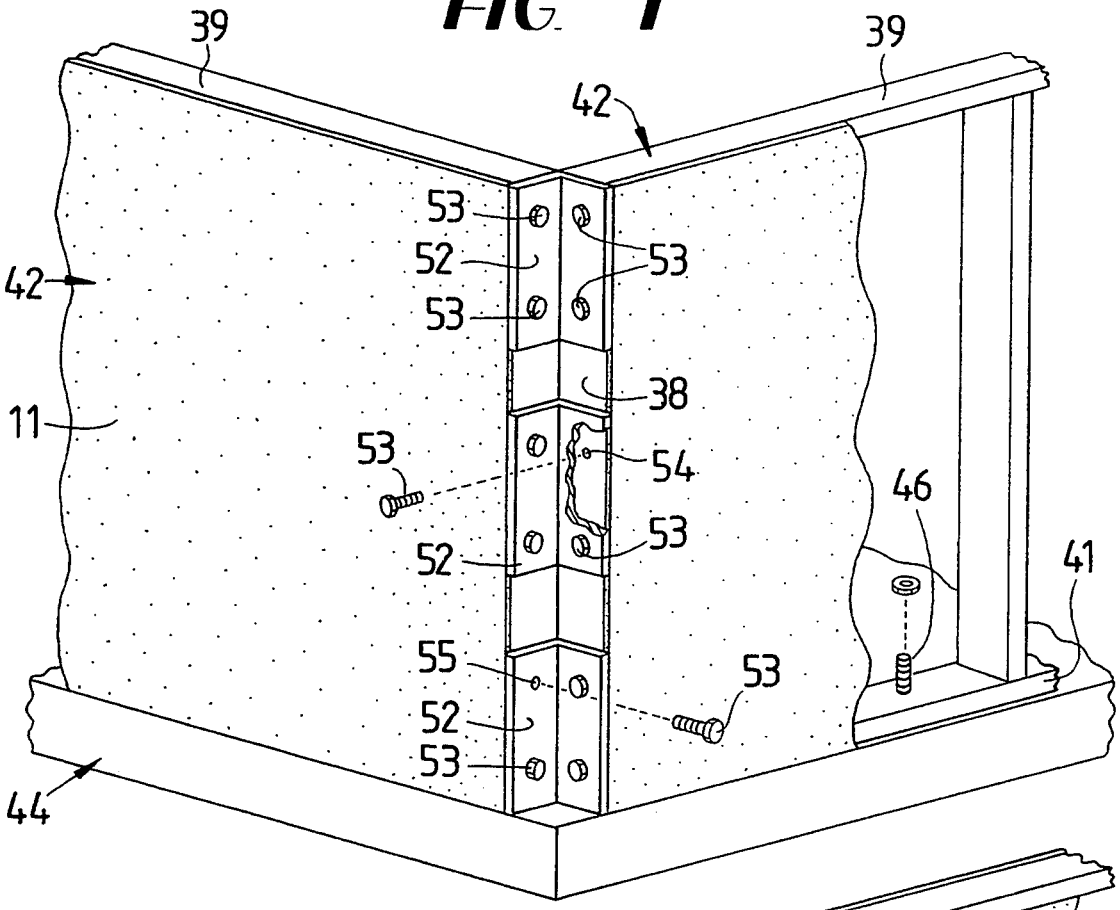
FIG. 7 is a perspective view of two panels connected as right angles to form a corner.

As shown in FIGS. 6 and 7, selected panels 10 and 42 are connected to the foundation 44 in angular and laterally adjacent relation and are connected to each other by one or more angle members 52 mounted intermediate the adjacent side beams 38 by bolts 53. The bolts 53 extend through corresponding apertures 54 and 55 defined within the side beams 38 and angle members 52, respectively.

Figure 9:
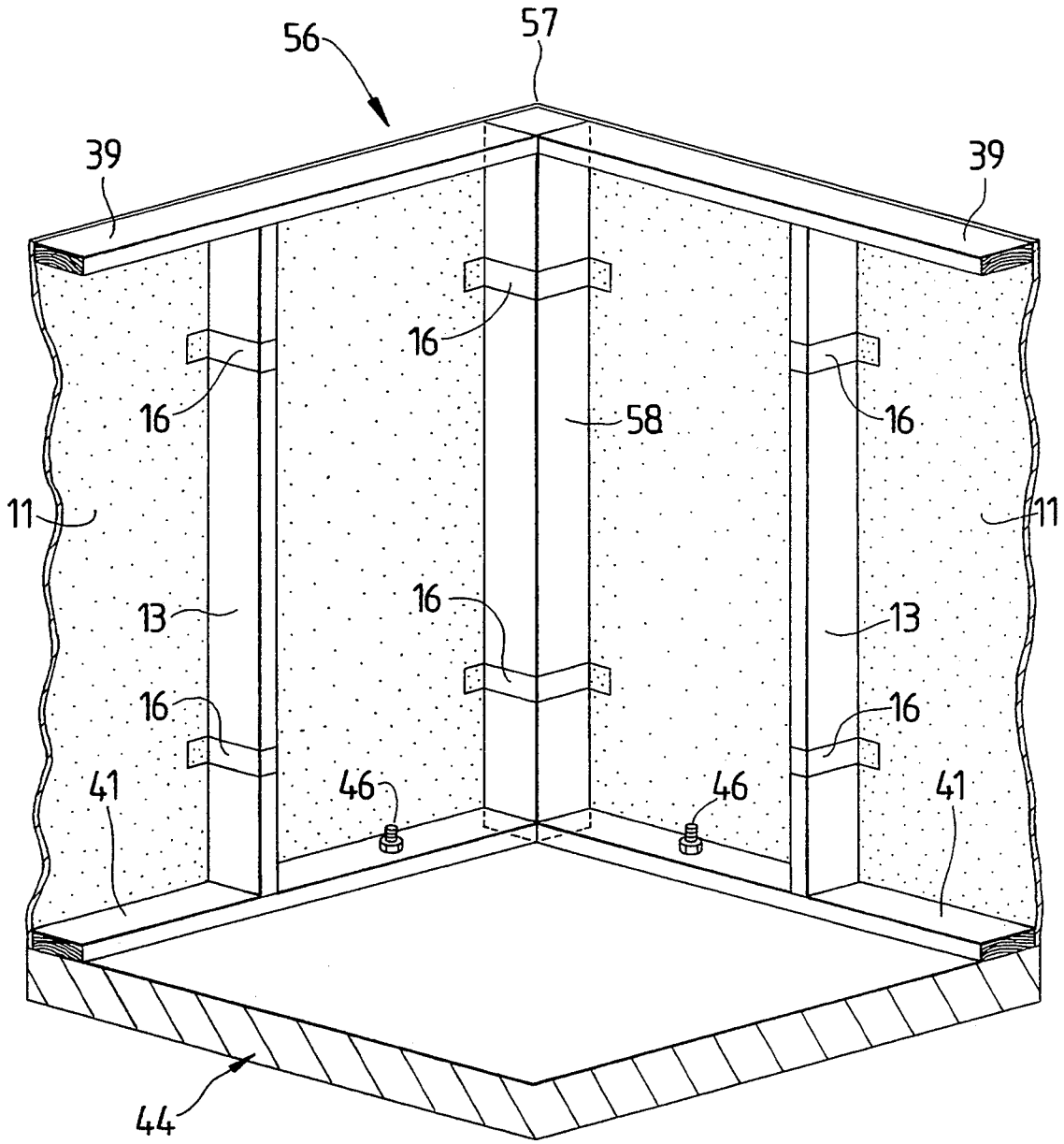
FIG. 9 is a perspective view of a corner panel.

The panels 10 and 42 are not limited to a planar shape. Panels having other configurations such as the corner panel 56, shown in FIG. 9, are easily constructed using the same methods, discussed herein, for constructing planar panels. The corner panel 56 is connected to the foundation 44 and forms a corner 57 having a corner post 58 extending therealong. The corner post 58 is connected to the upper and lower beam members 39 and 41, which are angled accordingly, and is partially immersed within the plastic sheet 11 and secured thereto by straps 16.

As shown in FIGS. 10–12, an alternate embodiment of the panel 10 is used as a billboard 59 having expansive height and width dimension and minimal thickness. The panel 10 includes the previously described plurality of beam members 12 immersed within the plastic sheet 11. The margins of the plastic sheet 11 are bonded to the outer sides 61 of the upper beam member 39, the lower beam member 41 and vertical side beams 38 and extend normal to the predominantly planar surface of the plastic sheet 11. Bolts 62 are embedded in selected ones of the plurality of beam members 13 and extend rearwardly therefrom and normal to the plastic sheet 11. The cover 27 is bonded to the frame 12 and the exposed portions of the plastic sheet 11, as previously described, with the bolts 62 protruding through the cover 27. The upper and lower beam members, 39 and 41, and the vertical side beams 38 have chamfered outer corners 63.

The edges 64 of the plastic cover 27 extend across the chamfered corner 63 and are bonded to the edges 66 of the plastic sheet 11 which extend proximal the chamfered corner 63 to form a groove 67. Bonding the plastic sheet 11 to the cover 27 in such a manner produces a billboard 59 having a frame 12 completely encased in reinforced plastic. A plurality of hangers 68 having apertures 69 therein receive the bolts 62 and are secured to the bolts 62 by nuts 71. As shown in FIGS. 10–12 each hanger 68 includes a rectangular base 72 held in pressed abutment with the beam member 13 by nuts 71. A pair of side portion 73 are integrally connected to laterally opposing edges of the base 72 in normal relation thereto. A substantially L-shaped clasp member 74 is connected to a lower edge of the base 72 and extends normally thereto then in parallel spaced relation to the beam member 13 to which the hanger 68 is connected. As shown in FIG. 11, brackets 76 are mounted to the selected surface 77 from which the billboard 59 is to be suspended. Preferably the bracket 76 is U-shaped having an elongated portion 78 spaced from the selected surface 77. The hanger 68 engages the elongated portion 78 and is supported thereon to secure the billboard 59 to the selected surface 77.

As shown in FIGS. 2-5, the panels are constructed by combining a plurality of liquefied plastics in a mold 34 with the first fiberglass weave 24 and the first mat 29. The process for combining includes spraying the mold 34 with a non-stick film 36, applying a liquefied first layer 21 of polyester resin and catalyst on the non-stick film 36, applying the first mat 22 on the first liquefied layer 21 of polyester resin and catalyst, applying a second liquefied layer 23 of polyester resin and catalyst on the first mat 22, applying the first fiberglass weave 24 on the second layer 23 of polyester resin and catalyst, applying a third liquefied layer 26 of polyester resin and catalyst on the first fiberglass weave 24, and compressing the first, second and third liquefied layers of polyester resin to remove air bubbles trapped therein and to permeate the polyester resin and catalyst within the first mat 22 and the first fiberglass weave 24.

Figure 5:
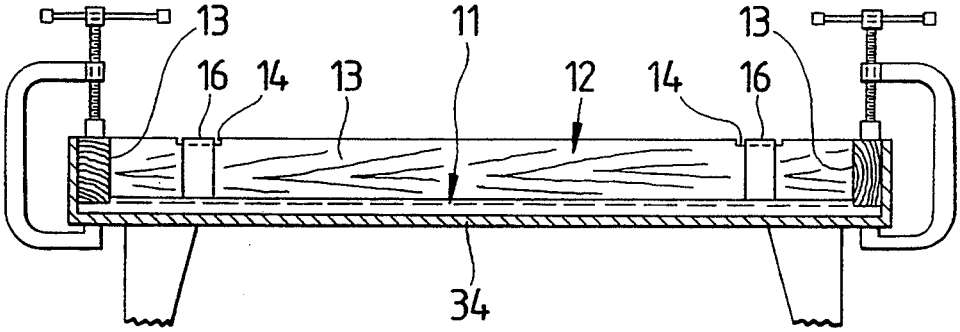
FIG. 5 is a sectional view of a mold with the first embodiment of the present invention engaged therein.

Once the layers have been compressed, the liquefied plastic is cured into a pliable semi-plastic stage. As shown in FIG. 5, beam members 13 are partially immersed within the semi-plastic third layer 26 of polyester resin and catalyst being held a predetermined distance therein by C-clamps 35 mounted to the mold 34. Subsequent to immersion, the beam members 13 are secured to the plastic sheet 11 by permitting the layers of plastic to completely cure. Upon curing, the plastic sheet 11 will bond with the beam members 13 immersed therein, thereby adequately securing the sheet 11 to the reinforcing beam members 13.

To construct the first embodiment, the plurality of straps 16 are pressed over selected beam members with the end portions 17 of those straps 16 being immersed within the plastic third layer 26 of resin and catalyst. The catalyst and resin are then completely cured, wherein the plastic permeating the straps 16 is solidified to further secure the beam members to the plastic sheet 11.

As shown in FIG. 4, the second embodiment of the present invention is constructed by completely curing the plastic sheet 11 with the frame 12 immersed therein as previously disclosed, thereafter applying the cover 27 over the frame 12 and the plastic sheet 11 in pressed engagement therewith. The layers of polyester resin and catalyst 28, 31 and 33 included in the cover 27 are then cured into a solid stage, wherein the polyester resin and catalyst bond the cover 27 with the plastic sheet 11 and the frame 12.

When the beam members 13 are secured to the plastic sheet 11 without the use of the cover 27, a layer of insulating polyurethane 37 foam is applied to the frame 12 and to the exposed portions of the third layer of polyester resin and catalyst. When the beam members 13 are secured to the plastic sheet 11 with a cover 27 the layer of polyurethane foam 37 is applied to the cover 27. From the foregoing, it should be clear that the present apparatus and method represent a substantial improvement over the prior art.

While I have shown my invention in two forms, it will be obvious to those skilled in the art that it is not so limited but is susceptible of various changes and modifications without departing from the spirit thereof.

What I claim is:

1. A prefabricated panel for use in construction comprising:

(a) a sheet of reinforced plastic;

(b) a rigid frame partially immersed within said plastic sheet for reinforcing said plastic sheet, wherein said plastic sheet is bonded to said frame, said frame comprising a plurality of interconnected beam members partially immersed within said plastic sheet and bonded thereto; and (c) a plurality of straps having end portions immersed in secured engagement within said plastic sheet, wherein each said strap traverses one of said plurality of beam members in spaced relation to said plastic sheet thereby securing said beam members to said plastic sheet, wherein each said strap includes a strip of woven mesh and a strip of matting, each soaked in plastic similar to that forming said plastic sheet and laminated across said beam member in normal stacked relation thereto.

2. A prefabricated panel as described in claim 1 wherein selected ones of said plurality of beam members define a plurality of transversely extending channels thereon within which said straps are received.

3. A prefabricated panel as described in claim 1 wherein said plastic sheet comprises a first fiberglass weave and a first mat bonded in parallel planar relation thereto by plastic.

4. A prefabricated panel as described in claim 3 comprising a cover bonded to said plastic sheet and said frame in pressed abutment therewith.

5. A prefabricated panel as described in claim 1 wherein said plurality of beam members comprise:

(a) at least two parallel vertical side beams defining the lateral margins of said panel;

(b) an upper beam member connected to an uppermost extremity of each said vertical side beams in perpendicular relation thereto; and (c) a lower beam member connected to a lowermost extremity of each said side beam in spaced parallel relation to said upper beam member.

6. A prefabricated panel, as described in claim 5, used in the construction of a building having a substantially horizontal foundation to which a plurality of threaded bolts are integrally connected in upward extension therefrom, wherein said lower beam member comprises a plurality of holes therein which receive selected ones of said plurality of bolts to secure said panel to said foundation in perpendicular relation thereto.

7. A prefabricated panel, as described in claim 5, aligned with other laterally adjacent panels of similar construction wherein adjacent ones of said side beams have a plurality corresponding apertures therein which receive a plurality of bolts therethrough for connecting said adjacent panels.

8. A prefabricated panel as described in claim 7 further comprising sealant bonded intermediate said adjacent side beams to provide a hermetic seal therebetween.

9. A prefabricated panel, as described in claim 5, positioned in angular and laterally adjacent relation to at least one other panel of similar construction, said panel further comprising one or more angle members connected intermediate adjacent side beams of said panel and said other panel by bolts extending through corresponding apertures defined within said angle members and said side beams.

10. A prefabricated panel as described in claim 7 wherein said panel is angled to form a corner and comprises a corner post extending vertically along said corner, wherein said corner post is partially immersed within and bonded to said plastic sheet and connected to said upper and said lower beam member.

11. A prefabricated panel for use in construction comprising:

a) a sheet of reinforcing plastic including a first fiberglass weave and a first mat bonded in paralled planar relation thereto by plastics;

(b) a rigid frame partially immersed within said plastic sheet for reinforcing said plastic sheet, wherein said plastic sheet is bonded to said frame; and (c) a cover bonded to said plastic sheet and said frame in pressed abutment therewith, wherein said cover comprises a second fiberglass weave and a second mat bonded thereto by plastic similar to that forming said plastic sheet, wherein said plastic is cured to a solid consistency thereby bonding said second fiberglass weave and said second mat to said plastic sheet and said frame.

12. A reinforced panel comprising a sheet of reinforced plastic molded about one face of a rigid frame having a plurality of beam members partially immersed within said plastic sheet and secured therein by a plurality of straps overlying said beam members and having end portions immersed within said plastic sheet, wherein said plastic sheet is cured to a solid consistency to bond with said frame and said end portions and wherein each said strap includes a strip of woven mesh and a strip of matting, each soaked in plastic similar to that forming said plastic sheet and applied across said beam member in transversely extending, stacked relation thereto.

13. A reinforced panel as described in claim 12 wherein selected ones of said plurality of beam members define a plurality of transversely extending channels thereon within which said straps are received.

14. A prefabricated panel as described in claim 12 further comprising a plurality of hangers connected to said frame opposite said plastic sheet for suspending said plastic sheet and said frame from a selected surface.

15. A prefabricated panel as described in claim 14 further comprising a cover bonded to said plastic sheet and said frame in pressed abutment therewith.

16. A prefabricated panel as described in claim 15 wherein said frame comprises a plurality of beam members interconnected in a common plane and partially immersed within said plastic sheet, wherein selected ones of said beam members have outer sides defining the lateral margins of said frame.

17. A prefabricated panel as described in claim 16 wherein said plastic sheet has edge portions extending along said outer sides of said selected beam members in bonded abutment therewith.

18. A prefabricated panel as described in claim 17 wherein said beam members are chamfered along an outer corner to form a groove, said groove being defined by a chamfered surface formed by said chamfering and said edge portion of said plastic sheet; wherein said cover is bonded to said chamfered surface and to said edge portion of said plastic sheet.

19. A prefabricated panel as described in claim 16 further comprising a plurality of bolts embedded within predetermined ones of said beam members and extending therefrom through said cover and normally to said plastic sheet, wherein said hangers receive said bolts and are secured thereto by nuts threadably connected to said bolts.

20. A prefabricated panel as described in claim 19 wherein each said hanger comprises:

(a) a rectangular base having an aperture therein for receiving one of said plurality of bolts, wherein said base is held in pressed abutment with a predetermined one of said beam members by said nut;

(b) a clasp integrally connected to said base and extending outwardly therefrom parallel to said predetermined one of said beam members.

* * * * *